US009423732B2

(12) United States Patent
Tsunashima et al.

(10) Patent No.: US 9,423,732 B2
(45) Date of Patent: Aug. 23, 2016

(54) FIXING DEVICE HAVING FIXING NIP FORMED BY ELASTIC ROLLER AND A BACK-UP UNIT WITH CYLINDRICAL FILM AND FILM GUIDE INCLUDING A PLURALITY OF RIBS EXTENDING CIRCUMFERENTIALLY ALONG THE INNER PERIPHERY OF THE FILM

(71) Applicant: CANON KABUSHIKI KAISHA, Tokyo (JP)

(72) Inventors: Karen Tsunashima, Tokyo (JP); Ryo Miyata, Yokohama (JP); Kazuhiro Doda, Yokohama (JP); Satoshi Nishida, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/816,437

(22) Filed: Aug. 3, 2015

(65) Prior Publication Data

US 2016/0033908 A1 Feb. 4, 2016

(30) Foreign Application Priority Data

Aug. 4, 2014 (JP) ..... 2014-158590
May 26, 2015 (JP) ..... 2015-106244

(51) Int. Cl.
*G03G 15/20* (2006.01)

(52) U.S. Cl.
CPC ..... *G03G 15/2046* (2013.01); *G03G 15/2078* (2013.01); *G03G 15/2089* (2013.01)

(58) Field of Classification Search
CPC ..... G03G 15/2089; G03G 15/2053; G03G 15/2046
USPC ..... 399/329
See application file for complete search history.

(56) References Cited

U.S. PATENT DOCUMENTS

| | | | |
|---|---|---|---|
| 6,671,489 | B2 | 12/2003 | Natshuhara et al. |
| 6,993,279 | B2 | 1/2006 | Fukuzawa et al. |
| 7,203,438 | B2 | 4/2007 | Omata et al. |
| 7,519,320 | B2 | 4/2009 | Aoki et al. |
| 7,650,105 | B2 | 1/2010 | Ogawa et al. |
| 7,702,249 | B2 | 4/2010 | Nishida |

(Continued)

FOREIGN PATENT DOCUMENTS

| | | | |
|---|---|---|---|
| JP | 2001-183930 | A | 7/2001 |
| JP | 2002-139932 | A | 5/2002 |

(Continued)

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

An image fixing device includes an elastic roller; a back-up unit forming a fixing nip with the roller therebetween, the back-up unit including a cylindrical film, a film guide, extending inside the film, for guiding the film, and an end portion guiding member including a guiding portion for guiding an inner surface of an end portion of the film. The film guide includes plural ribs contacting the film and arranged in a generatrix direction at positions upstream of the fixing nip with respect to a feeding direction of a sheet. The ribs have free end portions retracted more toward a downstream side with respect to the feeding direction of the recording material than the guiding portion of the end portion guiding member. An inside rib has a free end portion which is retracted more toward the downstream side than free end portions of the opposite end ribs.

4 Claims, 18 Drawing Sheets

(56) References Cited

U.S. PATENT DOCUMENTS

| | | | | |
|---|---|---|---|---|
| 7,734,241 | B2 | 6/2010 | Nishida et al. | |
| 7,787,792 | B2 | 8/2010 | Nishida | |
| 8,285,183 | B2 | 10/2012 | Nishida et al. | |
| 8,532,530 | B2 | 9/2013 | Nishida et al. | |
| 8,811,872 | B2 | 8/2014 | Nakagawa et al. | |
| 8,831,493 | B2 | 9/2014 | Tanaka et al. | |
| 8,891,989 | B2 | 11/2014 | Umeda et al. | |
| 9,014,608 | B2 | 4/2015 | Okayasu et al. | |
| 9,116,494 | B2 | 8/2015 | Tokuda | |
| 2003/0042240 | A1 | 3/2003 | Natshuhara et al. | |
| 2003/0077092 | A1 | 4/2003 | Ogawa et al. | |
| 2004/0218949 | A1* | 11/2004 | Fukuzawa | G03G 15/2053 399/328 |
| 2013/0322940 | A1* | 12/2013 | Ichiki | G03G 15/2064 399/329 |
| 2013/0330111 | A1 | 12/2013 | Tokuda | |
| 2014/0003847 | A1* | 1/2014 | Nishida | G03G 15/2064 399/329 |
| 2014/0023413 | A1 | 1/2014 | Shinji et al. | |
| 2014/0294465 | A1* | 10/2014 | Hazeyama | G03G 15/2017 399/329 |
| 2014/0314437 | A1 | 10/2014 | Nishida et al. | |
| 2014/0314458 | A1 | 10/2014 | Mitani et al. | |

FOREIGN PATENT DOCUMENTS

| | | | |
|---|---|---|---|
| JP | 2004-281286 | A | 10/2004 |
| JP | 2005-050693 | A | 2/2005 |
| JP | 2014-13377 | A | 1/2014 |

* cited by examiner (a)

(b)

FIXING DEVICE HAVING FIXING NIP FORMED BY ELASTIC ROLLER AND A BACK-UP UNIT WITH CYLINDRICAL FILM AND FILM GUIDE INCLUDING A PLURALITY OF RIBS EXTENDING CIRCUMFERENTIALLY ALONG THE INNER PERIPHERY OF THE FILM

FIELD OF THE INVENTION AND RELATED ART

The present invention relates to an image fixing device, which is suitable to an electrophotographic image forming apparatus which forms a toner image on a sheet of recording medium with the use of an electrophotographic image formation process and fixes the toner image to the sheet of recording medium by melting the toner image with the use of heat. As examples of an electrophotographic image forming apparatus, there are an electrophotographic copying machine, an electrophotographic printer (laser beam printer, LED printer, etc.), and the like.

As a fixing device employed by an electrophotographic image forming apparatus, there is a fixing device of the so-called fixation film type, which uses a fixation film, and which is known to be excellent in that it can start up very quickly on demand. A fixing device which employs a fixation film has a cylindrical film, a nip-forming member which contacts the inward surface of the cylindrical film, a film supporting member which has the roles of supporting the nip-forming member and guiding the film, and an elastic roller which forms a nip by being pressed against the film-supporting member with the presence of the film between itself and the film-supporting member, in cooperation with a nip forming member. A fixing device conveys, between its elastic roller and fixation film, a sheet of recording medium on which a toner image is present. It fixes the toner image to the sheet of recording medium by heating the sheet of recording medium and the toner image thereon while conveying the sheet.

In order to enable a fixing device of the heating film type to quickly startup, that is, to enable its heating film to quickly reach the target temperature, a film which is small in thermal capacity is employed as the heating film. As for the material for the film, in some cases, a metallic substance such as SUS (stainless steel) and Ni (nickel) is used, whereas in other cases, heat resistant resin such as PI (polyimide), PAI (polyamideimide, PEEK (polyether-etherketone) is used.

Generally speaking, a metallic substance is characterized in that it is stronger, being therefore more thinly extendable, than a resinous substance, and also, in that it is higher in thermal conductivity than a resinous substance.

In comparison, a resinous substance is advantageous over a metallic substance in that it is smaller in specific gravity, and more easily warm up, than a metallic substance. Among resinous substances, thermoplastic resins such as PEEK can be molded by extrusion, being therefore beneficial in that is can be inexpensively molded.

As the elastic roller of the above-described fixing device rotates by being driven, the film of the fixing device is rotated by the rotation of the elastic roller. Thus, the greater in size the area of contact between the inward surface of the film and the film supporting member, the greater the friction between the film and film supporting member, and therefore, the greater the friction between the film and film supporting member. Thus, in a case where the area of contact between the film and film supporting member of a fixing device is large in size, the fixing device 9 is unstable in recording medium conveyance. In addition, in a case where the area of contact between the inward surface of the film and film supporting member of a fixing device is large, heat is likely to easily escape, which sometimes results in problems related to the fixing performance of the fixing device, for example, the formation of nonuniform images, the nonuniformity of which is attributable to the nonuniformity in temperature of the fixation nip of the fixing device.

Therefore, in the case of some fixing devices of the so-called film heating type, their film supporting member is provided with ribs or holes, in order to reduce in size the area of contact between the film and the film supporting member which contacts the inward surface of the film. In particular, in the case of a fixing device, such as the above-described one, its film supporting member is provided with a preset number of narrow ribs.

In Japanese Laid-open Patent Application 2002-139932, it is disclosed to make the shape (in terms of cross-section perpendicular to its lengthwise direction) of the film supporting member roughly the same as the shape in which the film will be when the film is rotationally moved while remaining pressed by the elastic roller to form a nip having a preset width. That is, it has been known that a fixing device can be improved in the durability of its film, by preventing the problem that the film is frictionally worn by the local and concentrated contact between the film and film supporting member film.

However, in a case where a film supporting member such as the above described one disclosed in Japanese Laid-open Patent Application 2002-139932 is employed by a fixing device of the above described film heating type, it suffers from the following problem. That is, as the film is rotationally moved, the lengthwise end portions of the film become different in cross-section which is perpendicular to the lengthwise direction of the film (fixing device), from the center portion. Thus, certain portions of the film supporting member fail to contact the film. That is, certain portions of the film supporting member fail to accommodate the shape of the film. Thus, the parts of film come into contact with the film supporting member. Therefore, it sometimes occurs that the film is reduced in durability.

Thus, the primary object of the present invention is to provide a fixing device which is superior in terms of fixation film durability to any of conventional fixing devices.

SUMMARY OF THE INVENTION

According to an aspect of the present invention, there is provided a fixing device comprising an elastic roller; and a back-up unit cooperative with said elastic roller to form a fixing nip therebetween, said back-up unit including a cylindrical film contacting said elastic roller, a film guide, extending inside said film in a generatrix direction of said film, for guiding said film, and an end portion guiding member provided at an end portion of said film guiding member, said end portion guiding member including a guiding portion for guiding an inner surface of an end portion of said film with respect to the generatrix direction, wherein a toner image is heat-fixed on a recording material while feeding the recording material carrying a toner image through said nip, wherein said film guide includes a plurality of ribs contacting said film and arranged in the generatrix direction at positions upstream of said fixing nip with respect to a feeding direction of the recording material, wherein said ribs have free end portions which are retracted more toward a downstream side with respect to the feeding direction of the recording material than said guiding portion of said end portion guiding member, and wherein an inside rib with respect to the generatrix direction has a free end portion which is retracted more toward the downstream side than free end portions of said ribs at opposite end portions with respect to the generatrix direction.

Further features of the present invention will become apparent from the following description of exemplary embodiments with reference to the attached drawings.

BRIEF DESCRIPTION OF THE DRAWINGS part (a) of FIG. 1 is a sectional view of the pressure film supporting member of the comparative fixing device, which has ribs, as seen from the top side of the fixing device, and part (b) of FIG. 1 is a sectional view of the pressure film supporting member in the first embodiment, which has ribs, in the first embodiment of the present invention, as seen from the top side of the device.

Figure 8:
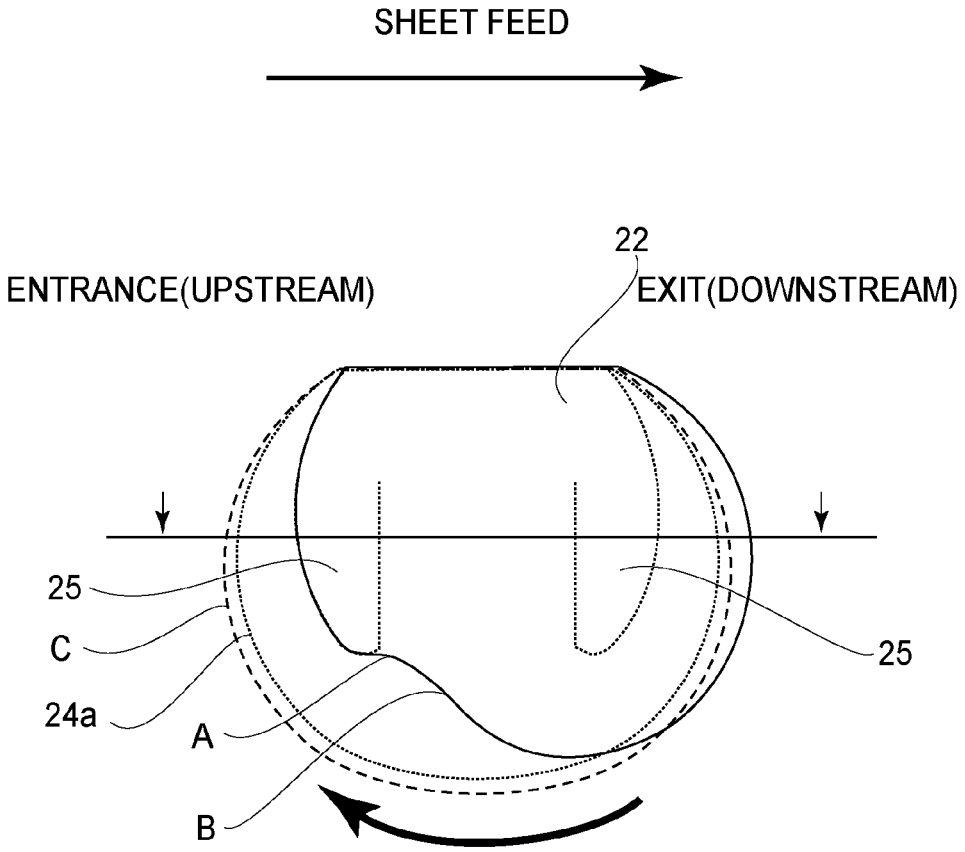

FIG. 8 is a drawing for describing the deformation which occurred to the pressure film of the comparative fixing device, in the adjacencies of the ribs of the pressure film supporting member, which correspond in position to the lengthwise end and center portions of the pressure film supporting member, before and after the temperature of the pressure film reached the glass transition point of the substrate of the pressure film.

Figure 9:
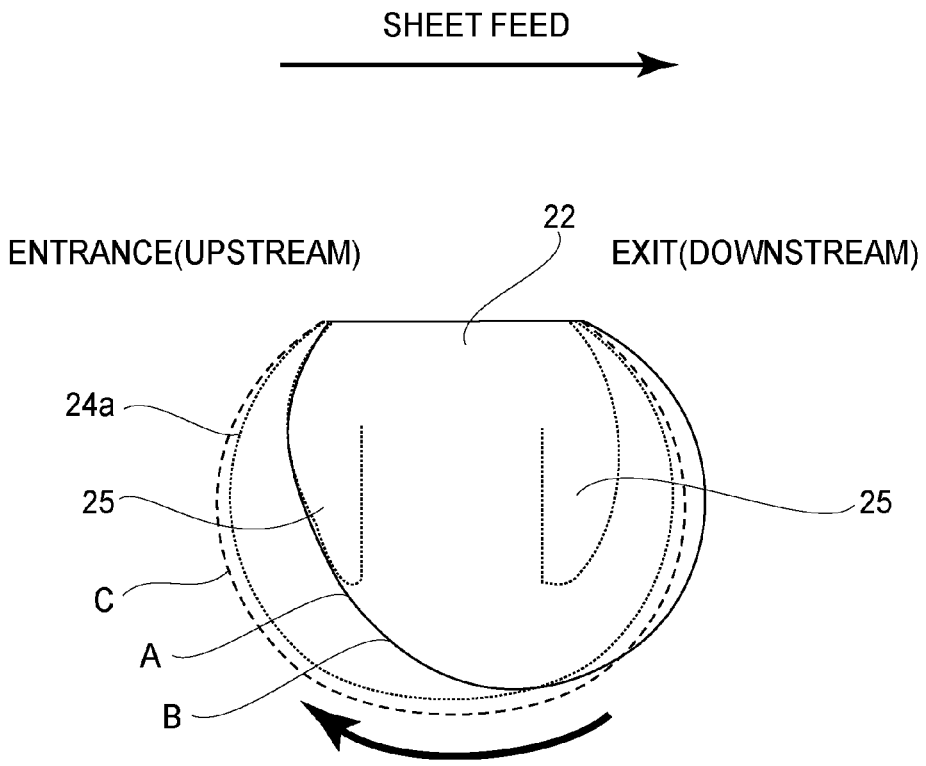

FIG. 9 is a drawing for describing the deformation of the pressure film of the fixing device in the first embodiment, which occurred in the adjacencies of the ribs of the lengthwise end and center portions of the pressure film supporting member, before and after the temperature of the pressure film reached the glass transition point of the substrative layer of the pressure film.

Figure 10A:
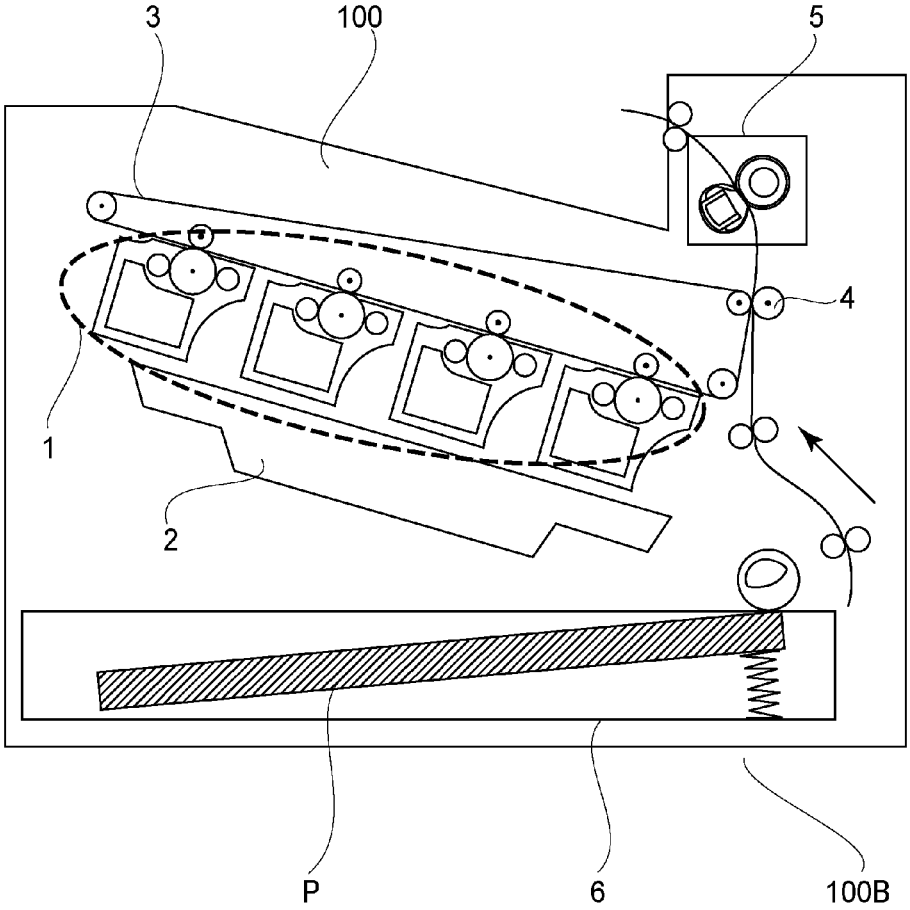

FIG. 10A is a sectional view of the image forming apparatus in a fourth embodiment of the present invention.

Figure 10B:
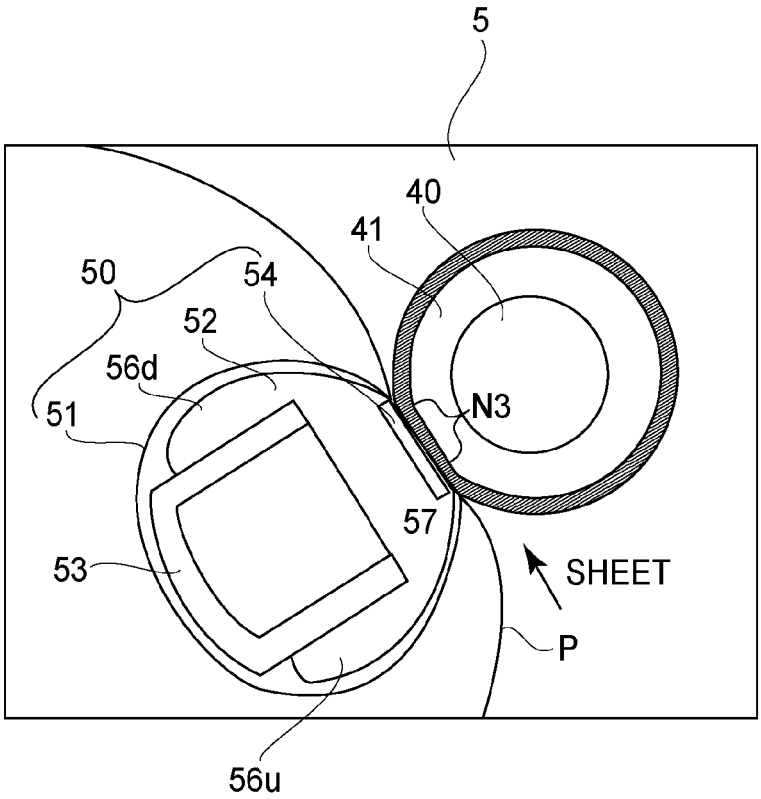

FIG. 10B is a sectional view of the fixing device according to the fourth embodiment.

Figure 10C:
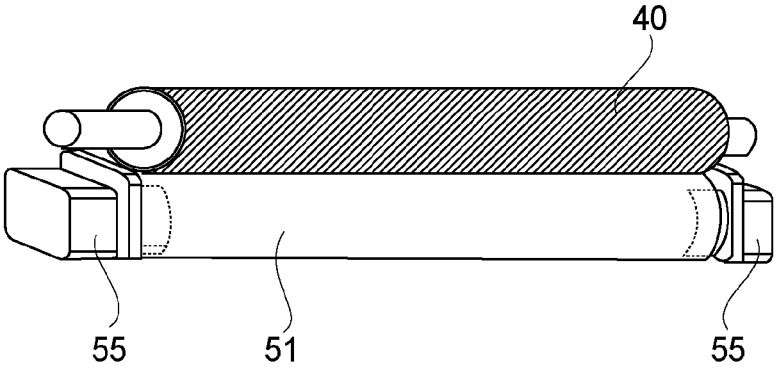

FIG. 10C is a perspective view of the fixing device according to the fourth embodiment of the present invention.

Figure 11:
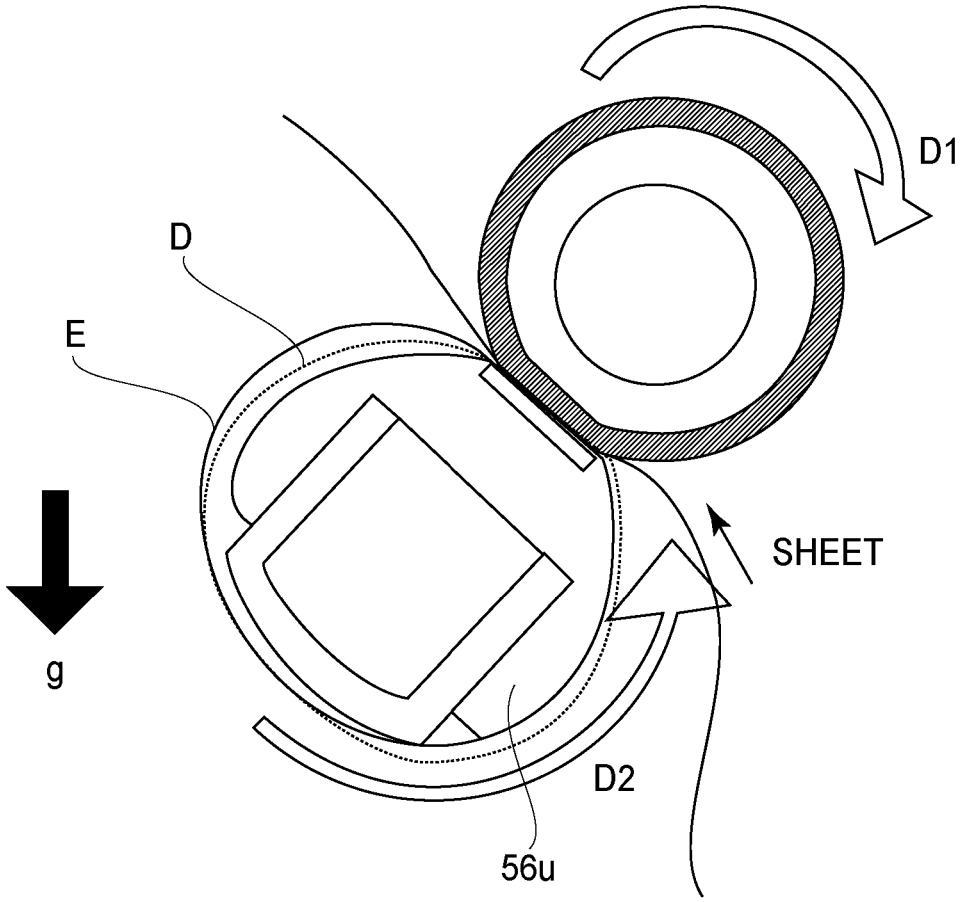

FIG. 11 is a sectional view of the fixing device (fourth embodiment).

Figure 12:
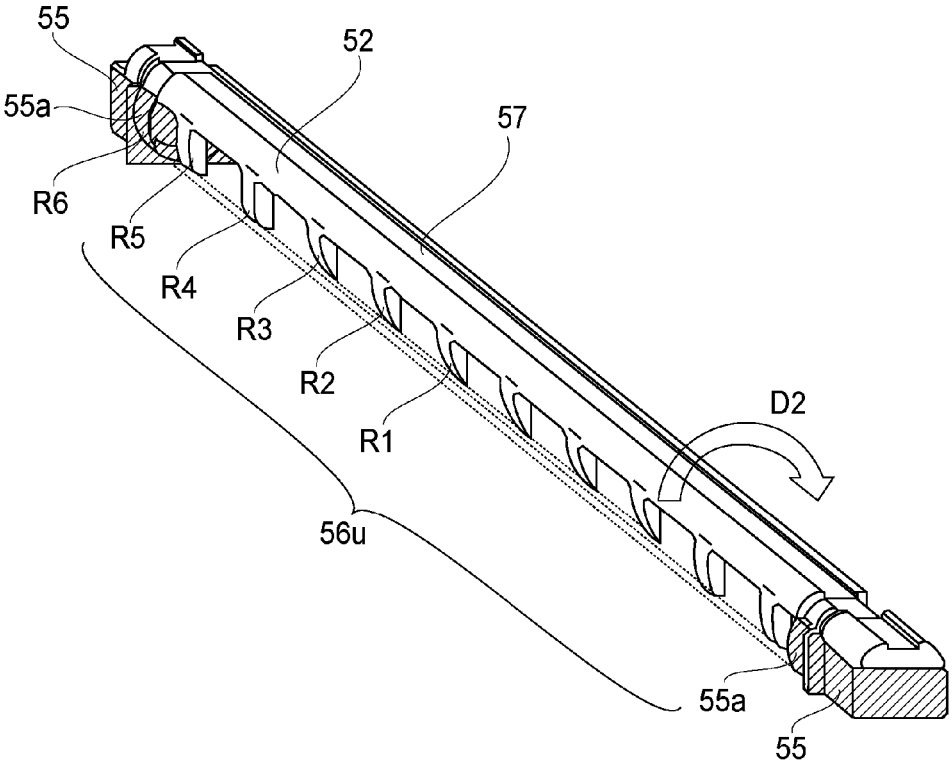

FIG. 12 is a perspective view of the pressure film supporting member.

Figure 13:
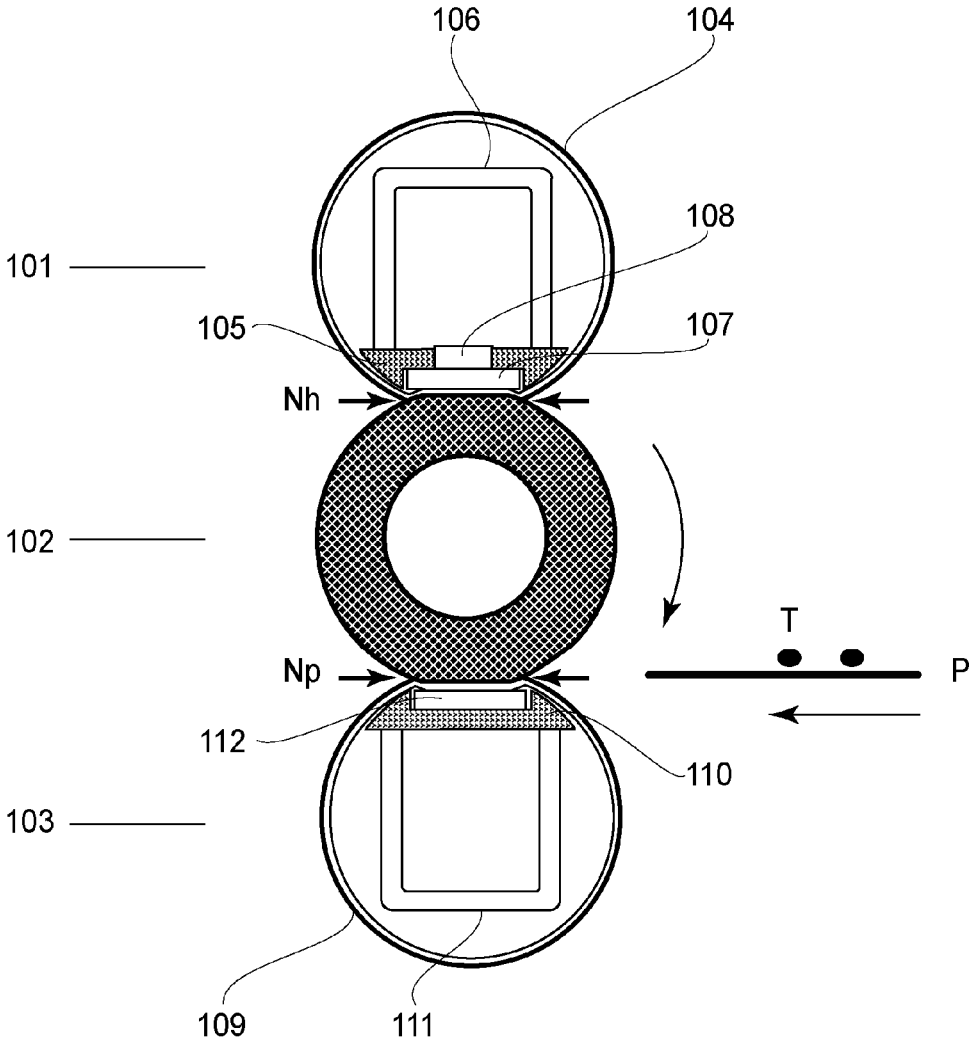

FIG. 13 is a sectional view of the fixing device (fifth embodiment).

Figure 14:
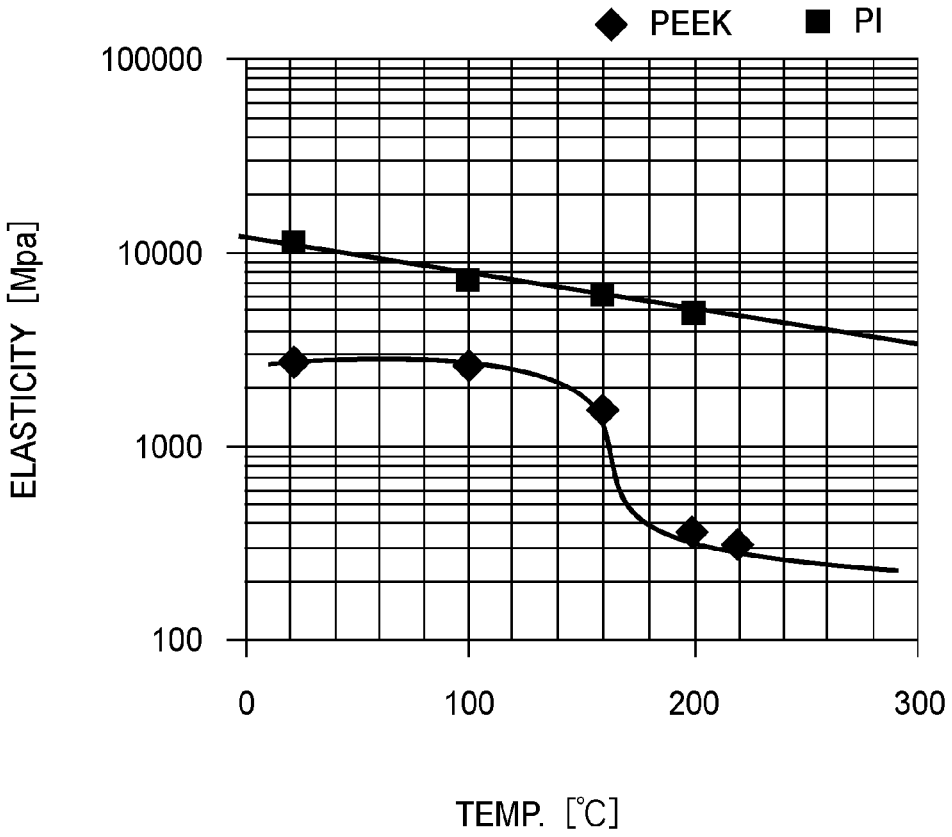

FIG. 14 is a drawing which shows the characteristic of the pressure film in terms of elasticity.

Figure 15:
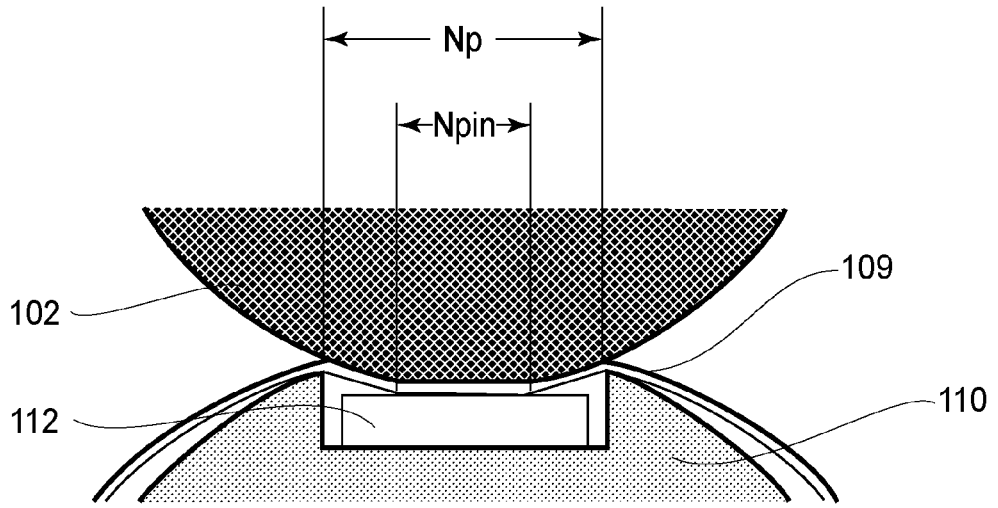
Figure 15:
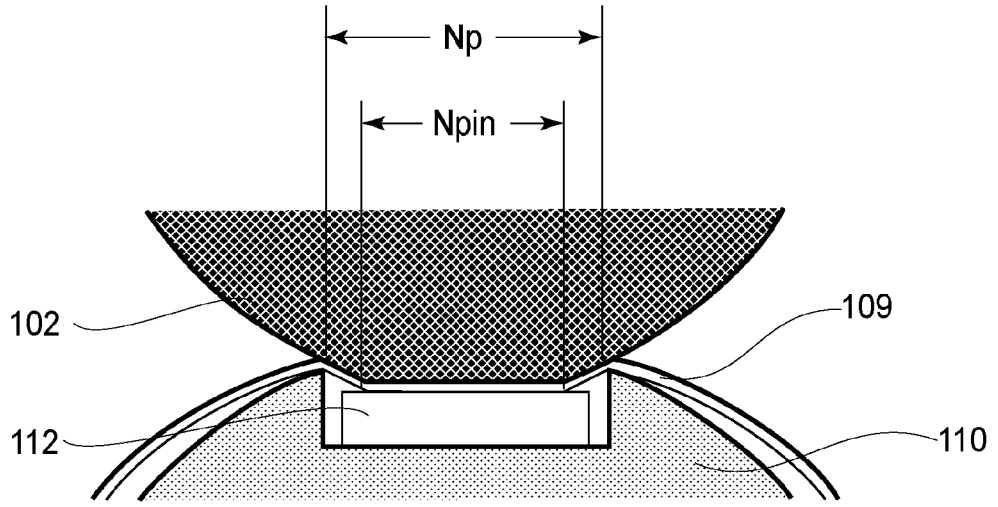

Parts (a) and (b) of FIG. 15 are an enlarged views of the fixation nip.

Figure 16:
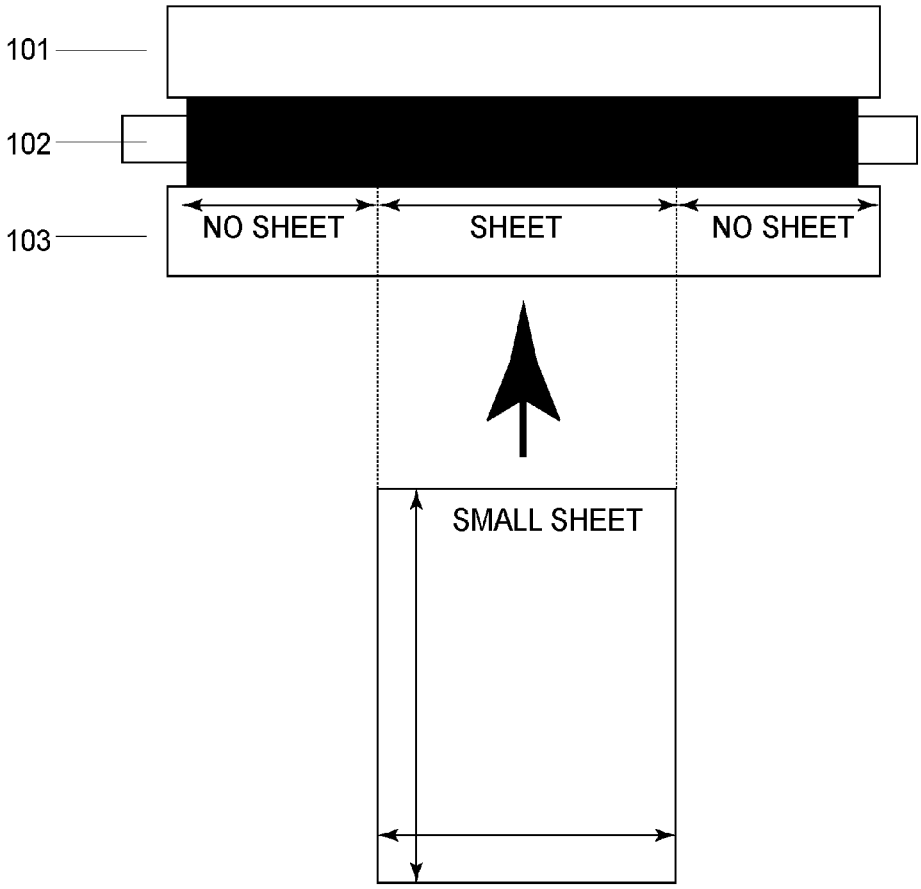

FIG. 16 is a drawing for describing a case in which a small sheet of recording paper is processed for fixation.

Figure 17:
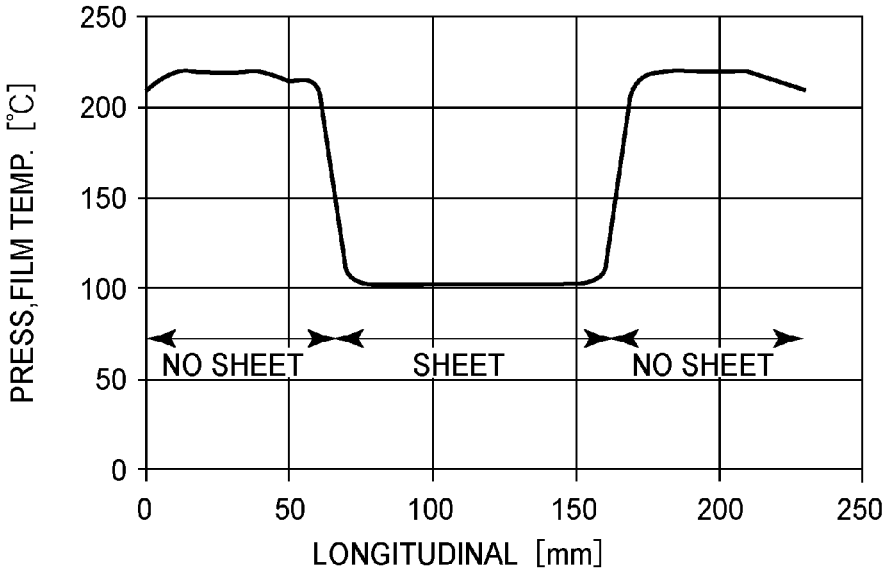

FIG. 17 is a drawing which shows the temperature distribution of the pressure film which occurs when a substantial number of small sheets of recording paper are continuously processed for fixation.

Figure 18:
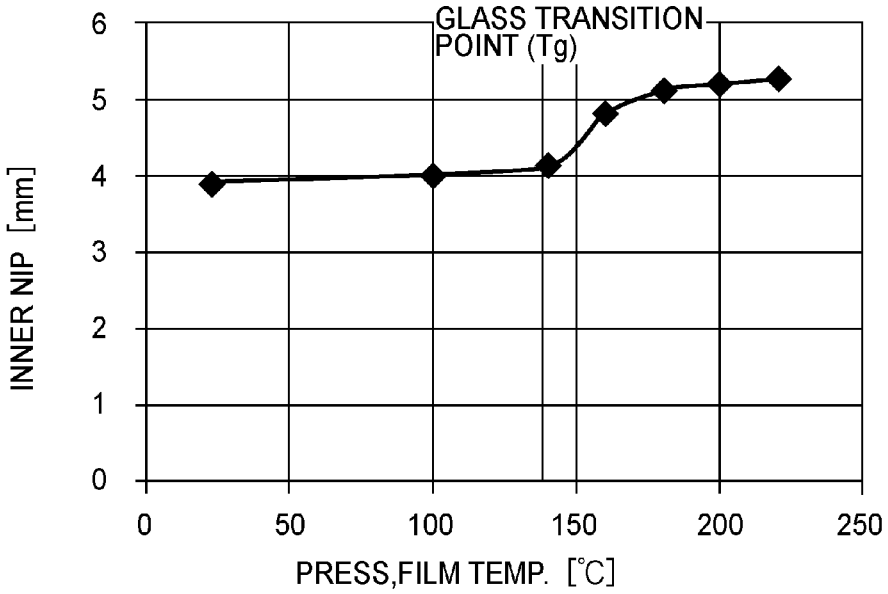

FIG. 18 is a drawing which shows the characteristics of the fixing device in the fifth embodiment, regarding the relationship between the width of the inward surface nip and the temperature of the pressure film.

Figure 19:
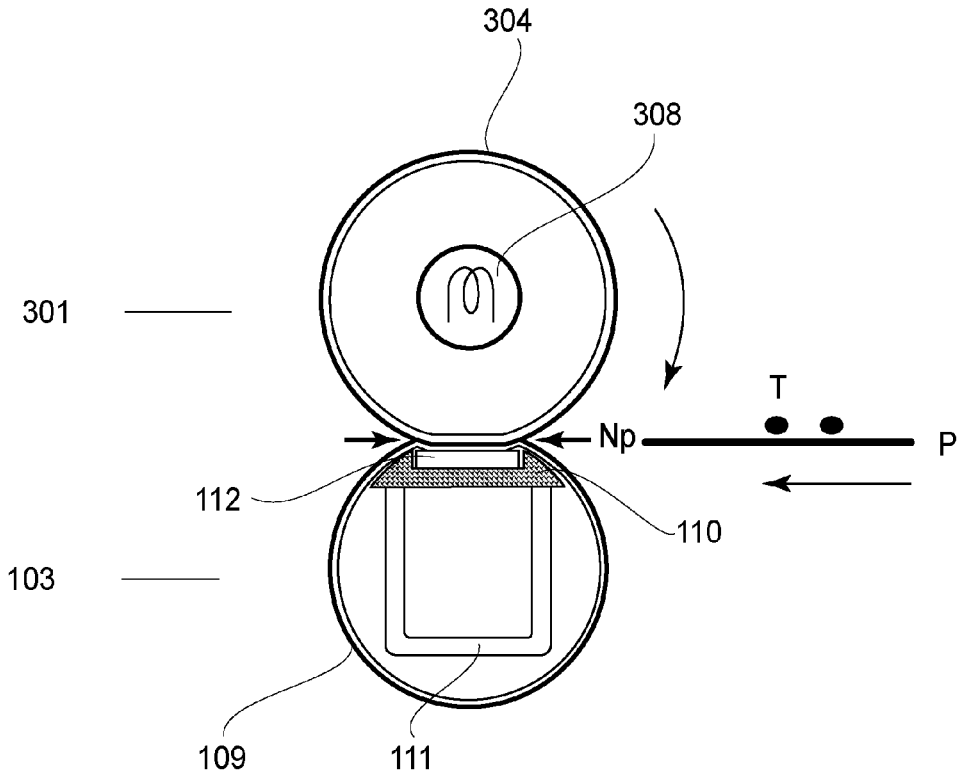

FIG. 19 is a sectional view of a modified version of the fixing device in the fifth embodiment.

DESCRIPTION OF THE EMBODIMENTS

Hereinafter, some of the preferred embodiments of the present invention are described with reference to appended drawing.

[Embodiment 1]

(Fixing Device)

Figure 6A:
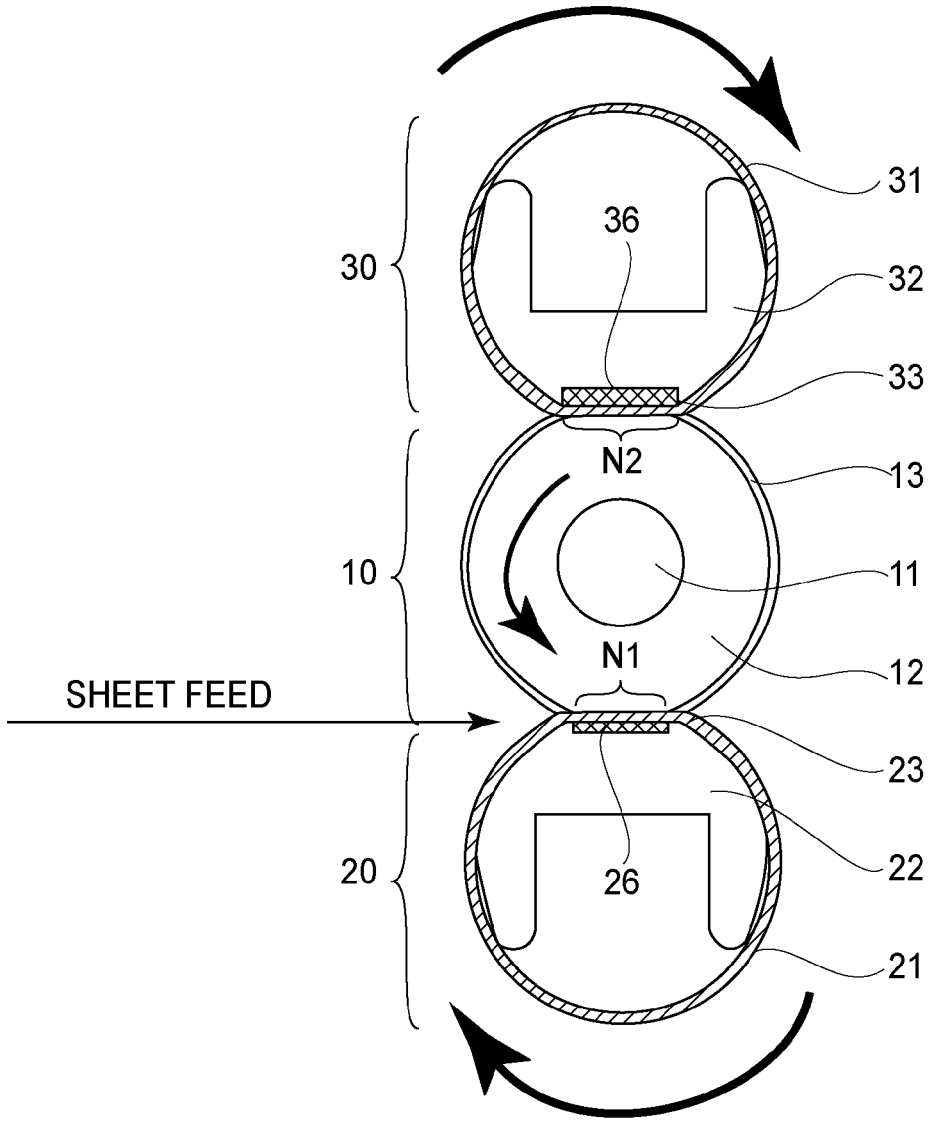
FIG. 6A is a cross-sectional view of the fixing device according to the first embodiment of the present invention.
Figure 6B:
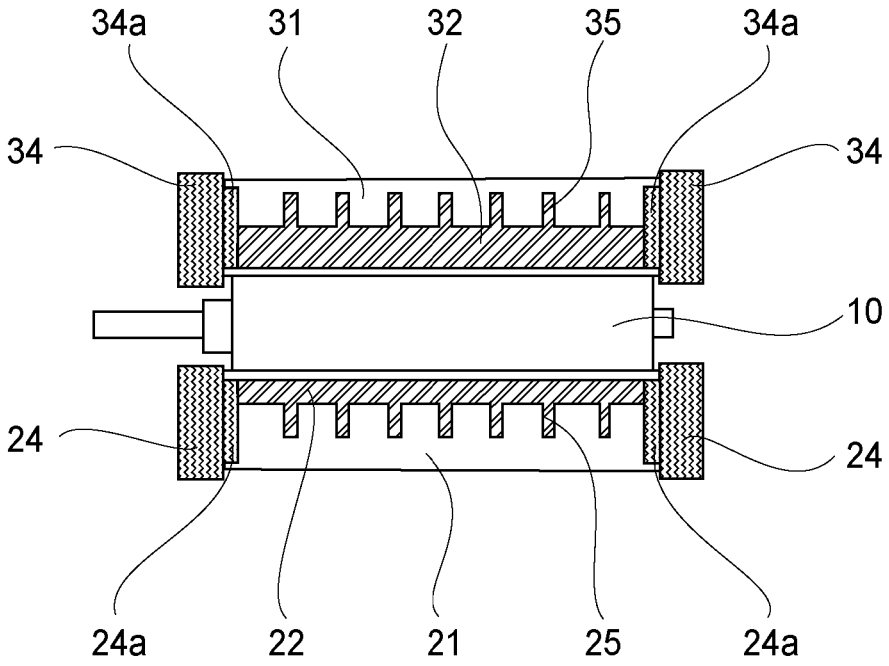
FIG. 6B is a longitudinal sectional view of the fixing device according to the first embodiment of the present invention.

First, referring to FIGS. 6A and 6B, the fixing device in the first embodiment of the present invention is illustrated. These Figures show the structure of a fixing device of the so-called external heating type, which employs a piece of film. Roughly speaking, the fixing device in this embodiment is made up of three sections, more specifically, a fixing roller 10 which is an elastic roller, a backup unit 20 which forms a fixation nip N1 (which is first nip), in cooperation with the fixing roller 10, and a heat supplying means 30 which is a heating unit. The heat supplying means 30 which is a rotational member contacts the fixing roller 10, outside the fixation nip N1, and forms a heating nip N2, in which it heats the peripheral surface of the fixing roller 10.

Being structured as described above, the fixing device in this embodiment conveys a sheet of recording medium on which a toner image is borne, through its fixation nip N1, while keeping the sheet P sandwiched between its fixing roller 10 and backup unit 20, and fixes the toner image to the sheet with the use of the fixing roller 10 heated by the heat supplying means 30.

a) Fixing Roller 10

The fixing roller 10 which is the first rotational member has a metallic core 11 which is made of such a metallic substance as iron, SUS, and aluminum. It has also an elastic layer 12 formed primarily of silicone rubber or the like, on the peripheral surface of the metallic core 11. Further, it has a release layer 13 formed primarily of fluorine resin such as PFA (copolymer of tetrafluoroethylene and perfluoroalkylvinylether), on the outward surface of the elastic layer 12.

b) Heat Supplying Means 30

The heat supplying means 30 in this embodiment, which is a heating unit, has a heating film supporting member 32 (heating film guiding member), a ceramic heater 33, and a pair of flanges 34. By the way, the heat supplying means 30 in this embodiment is such a heating means that employs a piece of film. This embodiment, however, is not intended to limit the present invention in scope in terms of heating means choice. That is, the present invention is also compatible with a heating means which employs a heat roller, a heating means based on radiant heat, a heating means based on electromagnetic induction, and the like.

The heating film 31 is a piece of cylindrical resin film, which has a substrative layer and a surface layer. The substrative layer is formed of PI (polyimide), PAI (polyamideimide), or the like, which is heat resistant and thermally insulative. The surface layer is formed of heat resistant resin such as PFA (copolymer of tetrafluoroethylene and perfluoroalkylvinylether), which is excellent in releasing property.

The heating film supporting member 32 is formed of a preselected heat resistant substance. It is roughly U-shaped in cross section. It is provided with a preset number of ribs 35 (FIG. 6B), which are aligned in the lengthwise direction (perpendicular to recording medium conveyance direction) of the heating film 31.

The pair of flanges 34 are formed of preselected heat resistant substance, and are attached to the lengthwise ends of the heating film supporting member 32, one for one. They have the role of regulating the movement of the heating film 31 in the lengthwise direction of the heating film 31, and also, the role of regulating the inward surface of the heating film 31. A referential code 34*a* stands for the portion of the flange 34, which regulates the inward surface of the lengthwise end of the heating film 31.

The ceramic heater 33 is supported by the film supporting member 32; it is fitted in a groove 34 with which the flat surface of the film supporting member is provided. The heating film 31 is loosely fitted around the portion of the heating film supporting member 32, by which the ceramic heater 33 is supported. The ceramic heater 33 forms a heating nip N2, which is the second nip, in cooperation with the fixing roller 10, with the presence of the heating film 31 between the ceramic heater 33 and fixing roller 10. The heating film 31 is rotationally moved around the heating film supporting member 32 by the rotation of the fixing roller 10, while remaining sandwiched between the ceramic heater 33 supported by the heating film supporting member 32, and the fixing roller 10.

This heat supplying means 30 is disposed in parallel to the fixing roller 10. Further, the lengthwise end portions of the heating film supporting member 32 are kept pressed toward the fixing roller 10 in the direction which is perpendicular to the lengthwise direction of the heating film 31, by a pair of compression springs (unshown). Thus, the surface of the ceramic heater 33 is pressed against the peripheral surface of the fixing roller 10 with the presence of the heating film 31 between the heat supplying means 30 and fixing roller 10, whereby the elastic layer 12 of the fixing roller 10 is elastically deformed, forming thereby the heating nip N2 having a preset width, between the fixing roller 10 and heating film 31.

As described above, the ceramic heater 33 bears the role of being a heating nip forming member.

c) Backup Unit 20

The backup unit 20 is made up of a heating film 21 which is the second rotational member, a pressure film supporting member 22 which is a film supporting member (pressure film guiding member), a nip forming member 23 which is a film-backing member, and a pair of flanges 24. The pressure film 21 is a piece of cylindrical film, and has a substrative layer formed of such thermoplastic resin as PI (polyimide), PAI (polyamide-imide), or the like, which is heat resistant and thermally insulative.

The pressure film supporting member 22 is formed of a preselected heat resistant substance. It is roughly U-shaped in cross section. It is provided with a preset number of ribs 25, which are aligned in the lengthwise direction (perpendicular to recording medium conveyance direction) of the pressure film 21, with the presence of a preset interval between the adjacent two ribs 25. The pair of flanges 24 (pressure film guiding member) are formed of preselected heat resistant substance, and are attached to the lengthwise ends of the pressure film supporting member 22, one for one. They have the role of regulating the movement of the pressure film 21 in the lengthwise direction of the heating film 31, and also, the role of regulating the inward surface of the heating pressure film 21. A referential code 24*a* stands for the portion of the flange 24, which regulates the inward surface of the lengthwise end of the pressure film 21.

The nip forming member 23 is formed of a metallic substance such as aluminum (highly thermally conductive member). It keeps the pressure film 21 uniform in the heat flow in the lengthwise direction (perpendicular to recording medium conveyance direction) of the pressure film 21. Further, the nip forming member 23 is supported by the pressure film supporting member 22; it is fitted in a groove 26, with which the flat surface of the pressure film supporting member 22 is provided, and which extends in the direction parallel to the lengthwise direction of the pressure film supporting member 22.

The pressure film 21 is loosely fitted around the portion of the pressure film supporting member 22, by which the nip forming member 23 is supported. The fixing roller 10 and nip forming member 23 form the fixation nip N1 between the pressure film 21 and fixing roller 10. The pressure film 21 is rotationally moved around the pressure film supporting member 22 by the rotation of the fixing roller 10, while remaining sandwiched between the fixing roller 10 and the nip forming member 23 supported by the pressure film supporting member 22.

This backup unit 20 is disposed in parallel to the fixing roller 10 which is the first rotational member. Further, the lengthwise end portions of the pressure film supporting member 22 are kept pressed toward the fixing roller 10 in the direction which is perpendicular to the lengthwise direction of the fixing roller 10, by a pair of compression springs (unshown). Thus, the nip forming member 23 of the backup unit 20 is pressed against the peripheral surface of the fixing roller 10 with the presence of the pressure film 21 between the backup unit 20 and fixing roller 10.

Thus, the elastic layer 12 of the fixing roller 10 is elastically deformed by the surface of the nip forming member 23, forming thereby the fixation nip N1 having a preset width, between the peripheral surface of the fixing roller 10 and the outward surface of the pressure film 21.

(Deformation of Pressure Film)

The deformation of the pressure film 21 is one of the causes of the reduction in the durability of the pressure film 21. Next, the process through which the pressure film 21 is deformed is described. Referring to FIGS. 6A and 6B, the rotation of the output shaft (unshown) of a fixing device driving motor is transmitted to the metallic core 11 of the fixing roller 10 through a preselected gear train (unshown), whereby the fixing roller 10 is rotated at a preset speed. The rotation of the fixing roller 10 is transmitted to the pressure film 21 by the friction which occurs between the peripheral surface of the outward surface of the pressure film 21 and fixing roller 102, in the fixation nip N1, whereby the pressure film 21 is rotated by the rotational movement of the fixing roller 10, with the inward surface of the pressure film 21 sliding on the film supporting member 22 and nip forming member 23.

While the pressure film 21 is rotated as described above, it remains subjected to the force which is generated by the fixing roller 10 in the direction parallel to the rotational direction of the fixing roller 10. That is, the pressure film 21 is pushed toward the exit side of the fixation nip N1 (downward). Consequently, the pressure film 21 is deformed (as indicated by lines B and C in FIG. 7). However, in the areas corresponding to the lengthwise ends of the pressure film supporting member 22, which are fitted with the flanges 24, the pressure film 21 is regulated, by its inward surface, by the guiding portion 24*a* which guides the pressure film 21 by the inward surface of the pressure film 21. Therefore, these portions of the pressure film 21 remain undeformed (as indicated by line C in FIG. 7).

Figure 7:
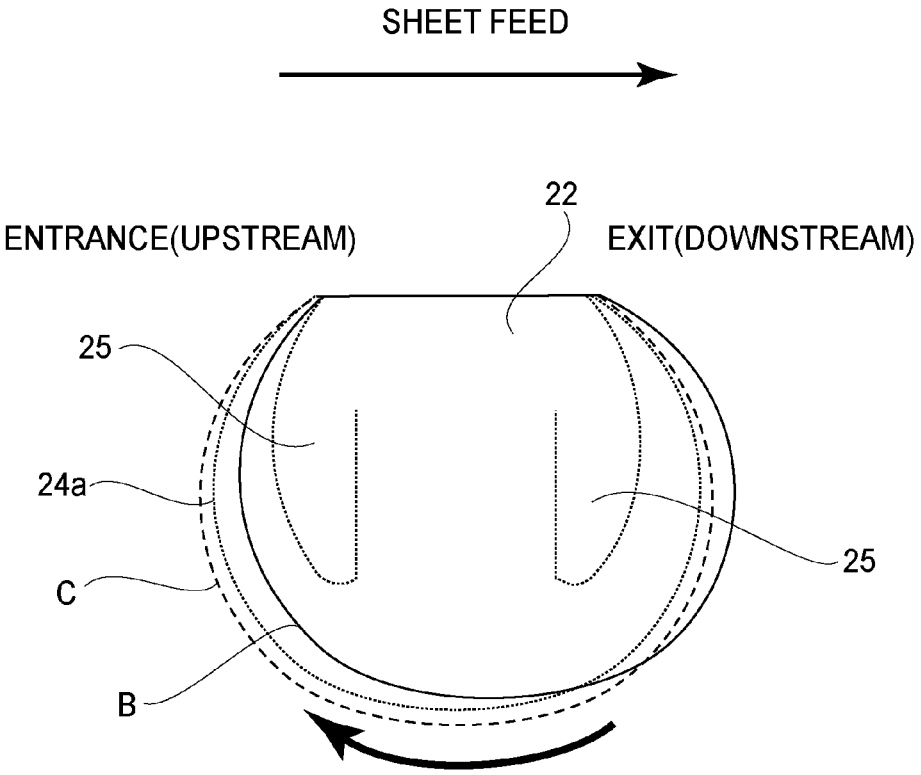
FIG. 7 is a drawing for describing the deformations which occur to the portions of the pressure film, in the adjacencies of the ribs of the pressure film supporting member, which correspond in position to the lengthwise end and center portions of the pressure film supporting member, when the pressure film is rotationally moved.

That is, referring to FIG. 7, the pressure film 21 is deformed in such a manner that its center portion, in terms of its lengthwise direction, convexly deforms toward the exit side of the fixing device. In comparison, the lengthwise end portions of the pressure film 21 are very small in the amount of the above described convex deformation. That is, in terms of the lengthwise direction of the pressure film 21, the pressure film 21 is not uniform the deformation. It is possible to confirm that on the upstream side of the fixing device, the pressure film 21 is deformed in such a manner that its center portion concaves.

Sometimes, the deformation of the pressure film 21, which occurs as the pressure roller 24 is rotationally moved, becomes greater than the one shown in FIG. 6A. As the causes of the exacerbation of the deformation of the pressure film 21 which occurs as the pressure film 21 is rotationally moved, the reduction in the elasticity of the pressure roller 24 itself, increase in the amount of the force which the pressure roller 24 receives from the fixing roller 10, etc., are thinkable. As the causes of the reduction in the elasticity of the pressure film 21 itself, the choice of the material for the pressure film 21, reduction in pressure film 21 thickness, softening of the pressure film 21, which occurs as the temperature of the pressure film 21 becomes higher than the glass transition point of the substrative layer of the film 21, etc., can be listed. As for the latter cause, that is, the cause of the increase in the amount of force which the peripheral surface receives from the fixing roller 10, the increase in the speed of the rotational movement of the pressure roller 24, increase in the friction between the fixing roller 10 and pressure film 21, etc., can be listed.

(Shape of Comparative Film Supporting Member, and deformation of Pressure Film)

FIG. 8 is a drawing which shows the deformation which occurs to the pressure film 21 of the comparative fixing device, in the adjacencies of the lengthwise center portion of the pressure film supporting member 22, before and after the temperature of the pressure film 21 reaches its glass transition point. While the fixing device is in use, the pressure film 21 increases in temperature. If the temperature of the pressure film 21 becomes higher than the glass transition point of the substrative layer of the pressure film 21, the pressure film 21 softens (reduces in elasticity). Consequently, the deformation of the pressure film 21, which occurs as the pressure film 21 is rotationally moved, becomes greater than that shown in FIG. 6A. By the way, even in a case where the pressure film 21 progressively deforms due to other factors than the increase in the temperature of the pressure roller 24, the deformation is similar to the one shown in FIG. 8. That is, the cause for the progressive deformation of the pressure roller 24 is not limited to the phenomenon that while the fixing device is used, the temperature of the pressure roller 24 becomes higher than the glass transition point of the substrative layer of the pressure film 21.

Referring to FIG. 8, as the temperature of the pressure film 21 becomes higher than the glass transition point of the substrative layer of the pressure film 21 while the fixing device is in use, the portion of the pressure film 21, which corresponds to the center portion of the pressure film supporting member 22, deforms in such a manner that it conforms to the film supporting member 22 (it comes into contact with the ribs 25 (position A)), on the entrance (upstream) side of the fixation nip N1. On the other hand, on the exit side (downstream) side of the fixation nip N1 shown in FIG. 8, the pressure film 21 deforms in such a manner that its distance from the ribs 25 becomes greater than when the temperature of the pressure film 21 is below the glass transition point of the substrative layer of the pressure film 21.

As described above, in the area which corresponds to the lengthwise center portion of the pressure film supporting member 22, the pressure film 21 deforms in such a manner that its concaves on the entrance side (upstream side) of the fixation nip N1 at the position A (FIG. 8). If the fixing roller 10 is continuously rotated while the pressure film 21 is in the above described condition, the lengthwise center portion of the pressure film 21 is pressed upon the ribs 25 of the pressure film supporting member 22 with a substantial amount of force. Consequently the pressure film 21 is scarred, and therefore, it is reduced in durability.

(Shape of Film Supporting Member, and Pressure Film Deformation, in this Embodiment)

Figure 1:
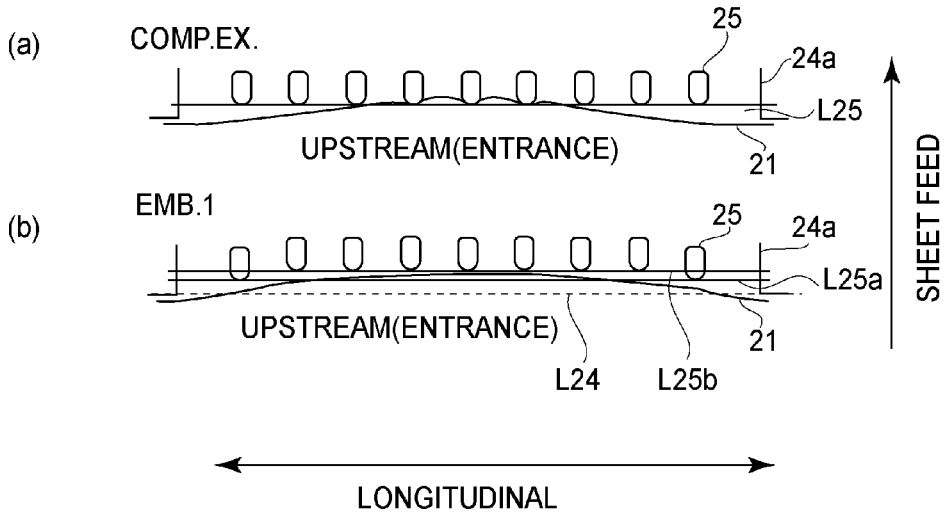

Next, this embodiment is described with regard to the mechanism of how the occurrence of the problem attributable to the above described pressure film deformation can be prevented by the modification in the shape of the pressure film supporting member 22. Part (a) of FIG. 1 is a sectional view of the nip entrance side of the pressure film supporting member 22 in the comparative fixing device, as seen from the top side of the fixing device, and part (b) of FIG. 1 is a sectional view of the nip entrance side of the pressure film supporting member 22 in this embodiment, as seen from the top side of the fixing device. Referring to FIG. 1, as the most outwardly bulging portion of each rib 25 is seen, in cross section, from the top side of the fixing device above, it appears like a tooth.

Regarding the most outwardly bulging portion of each rib 25, and its radius of curvature, the smaller a given rib 25 in radius of curvature, the higher it is in the position of its bottom end. Referring to part (a) of FIG. 1 which is related to the comparative fixing device, all the ribs 25, which are aligned in the lengthwise direction of the pressure film supporting member 22, are the same in radius of curvature, and therefore, they are the same in the position of their bottom end, being at a line L25 in FIG. 1, in terms of the height direction of the fixing device. In comparison, referring to part (b) of FIG. 1 which is related to the fixing device in this embodiment, all the ribs 25 are aligned in the lengthwise direction of the pressure film supporting member 22, but are not the same in radius of curvature. More specifically, the pressure film supporting member 22 is structured so that the ribs 25 which belong to the center portion of the pressure film supporting member 22, are smaller in radius of curvature than the ribs 25 which belong to the end portions of the pressure film supporting member 22. Therefore, the position of the bottom end of each of the ribs 25 which belong to the center portion of the pressure film supporting member 22, is positioned higher than that of each of the ribs 25 which belong to the end portions of the pressure film supporting member 22.

That is, the ribs 25 of the pressure film supporting member 22 of the comparative fixing device, are the same in shape as seen from the lengthwise direction of the pressure film supporting member 22 (part (a) of FIG. 1). In comparison, in order to prevent the pressure film 21 from being locally deformed, by making the ribs 25 equal in the amount of force they receive from the pressure film 21, the pressure film supporting member 22 in this embodiment is structured so that the ribs 25 which belong to the center portion of the pressure film supporting member 22, are smaller in radius of curvature than those which belong to the lengthwise end portions of the pressure film supporting member 22. A line L25*a* in part (b) of FIG. 1 indicates the position of the tip of the outermost rib 25, in terms of the lengthwise direction of the pressure film supporting member 22, in terms of the recording medium conveyance direction. A line L25*b* indicates the position of the tip of the other ribs. As is evident from these drawings, the tip of the center rib 25 in terms of the lengthwise direction is positioned more upstream, in terms of the recording medium conveyance direction, than the tip of the outermost rib 25. By the way, the outermost end rib 25 is recessed from the peripheral surface of the film guiding portion 24*a* of the flange 24.

Figure 2:
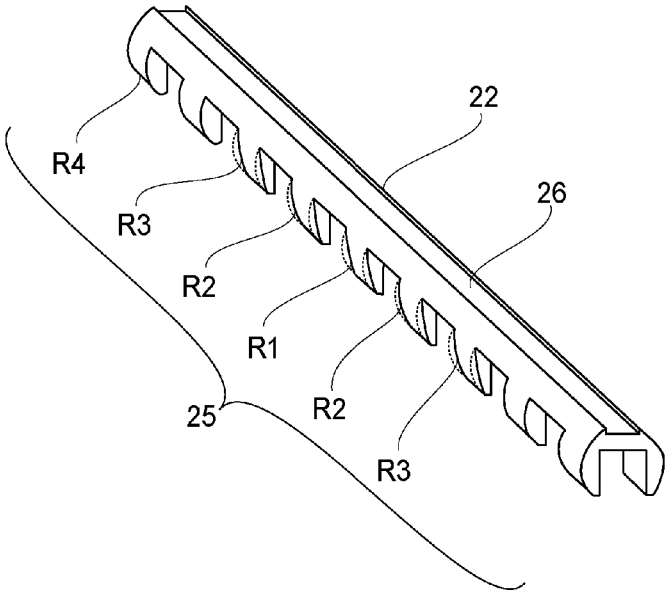
FIG. 2 is a schematic perspective view of the pressure film supporting member having ribs, in the first embodiment.

FIG. 2 is a schematic perspective view of the pressure film supporting member 22 in this embodiment. Referring to FIG. 2, a referential code R1 stands for the radius of curvature of the central (first) rib 25 of the pressure film supporting member 22 in terms of the lengthwise direction, and referential codes R2 and R3 stand for the radiuses of curvatures of the second and third ribs 25, respectively, counting from the lengthwise center of the pressure film supporting member 22. A referential code R4 stands for the radius of curvature of the outermost rib 25. The pressure film supporting member 22 in this embodiment is shaped so that there is the following relationship among the radiuses of curvatures R1, R2, R3 and R4: R4>R1=R2=R3. That is, the pressure film supporting member 22 is shaped so that the ribs 25 which belong to the center portion of the pressure film supporting member 22 are recessed inward of the pressure film supporting member 22 compared to the outermost ribs 25. The ribs 25 other than the outermost ribs 25 are the same in radius of curvature. Further, the above-described ribs 25 are desired to be made as narrow as possible to prevent the problem that heat escapes from the pressure film 21 through the ribs 25, and therefore, the portions of the toner image, which correspond in position to the ribs 25, are unsatisfactorily fixed. Moreover, it is desired that the number of the ribs 25 is as large as possible so that the force which the pressure film supporting member 22 receives from the pressure film 21 is distributed as uniformly as possible across the pressure film supporting member 22 in terms of the lengthwise direction of the pressure film supporting member 22.

FIG. 9 shows the shape (in terms of cross section) of the portion of the pressure film 21, which corresponds to the center portion of the pressure film supporting member 22, before and after the temperature of the pressure film 21 reaches the glass transition point of the substrative layer of the pressure film 21, in this embodiment. Referring to FIG. 9, the pressure film supporting member 22 in this embodiment did not concave inward of the pressure film supporting member 22 at the point A, unlike in the case of the comparative pressure film supporting member 22 shown in FIG. 8.

The material for the pressure film 21 may be thermosetting resin such as thermosetting PI (polyimide). In a case where thermosetting resin is used as the material for the pressure film 21, the effects of the present invention is smaller than in a case where thermoplastic resin is used as the material for the pressure film 21. However, thermosetting resin is superior in terms of the durability of the pressure film 21. In a case where thermoplastic resin is used as the material for the pressure film 21, as the temperature of the pressure film 21 exceeds the glass transition point of the material for the pressure film 21, the pressure film 21 softens, and therefore, increases in the amount of its deformation. Thus, in a case where thermoplastic resin is used as the material for the pressure film 21, this embodiment which makes the ribs which belong to the center portion of the pressure film supporting member 22, different in shape (radius of curvature) from the ribs which belong to the outermost ribs of the pressure film supporting member 22, is remarkably effective.

[Embodiment 2]

Figure 3:
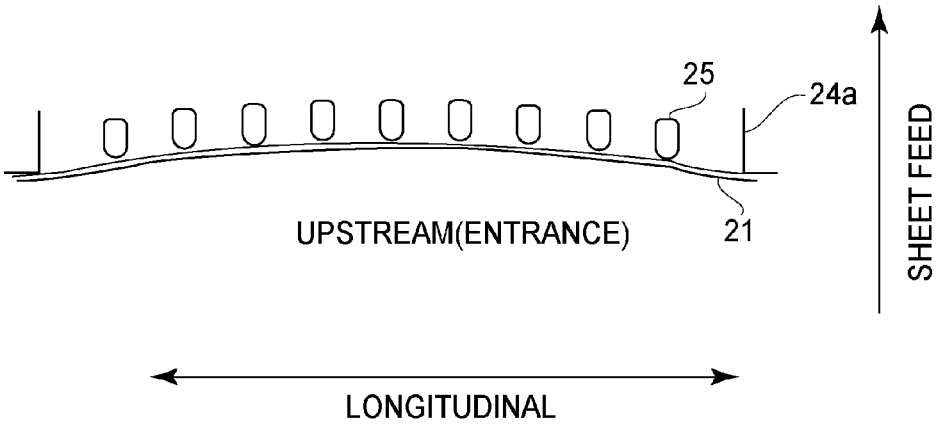
FIG. 3 is a sectional view of the pressure film supporting member having ribs, in the second embodiment, as seen from the top side of the fixing device.

FIG. 3 is a sectional view of the pressure film supporting member 22 in the second embodiment of the present invention, as seen from above the fixing device. Also in this embodiment, in order to prevent the pressure film 21 from being locally deformed, the ribs 25 which belong to the lengthwise center portion of the pressure film supporting member 22, are made smaller in radius of curvature than the outermost ribs 25 of the pressure film supporting member 22 so that the pressure film supporting member 22 becomes uniform (in terms of its lengthwise direction) in the force which it receives from the pressure film 21, as in the case of the first embodiment.

Figure 4:
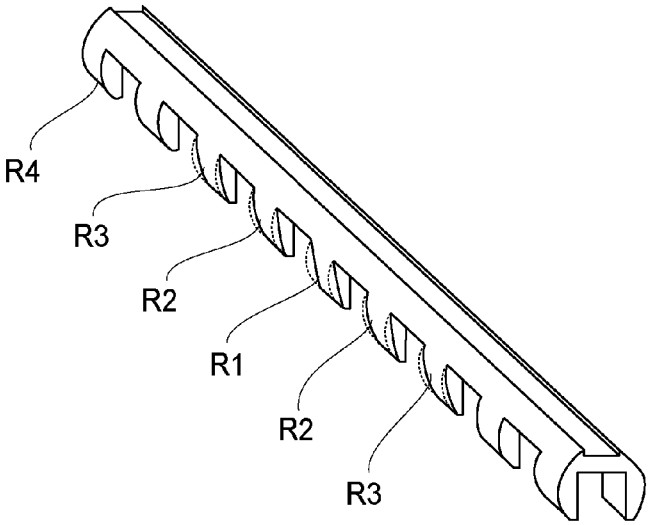
FIG. 4 is a schematic perspective view of the pressure film supporting member having ribs, in the second embodiment.

FIG. 4 is a schematic perspective view of the pressure film supporting member 22 in this embodiment. In FIG. 4, referential codes R1, R2 and R3 stand for the radiuses of curvature of the first (central), second, and third ribs 25, respectively, listing from the lengthwise center of the pressure film supporting member 22, and a referential code R4 stands for the radius of curvature of the lengthwise end rib. In this embodiment, the pressure film supporting member 22 is structured so that the outermost ribs 25 are the largest in radius of curvature, and the closer to the lengthwise center of the pressure film supporting member 22 a given rib 25 is, the smaller it is in radius of curvature: R4>R3>R2>R1.

This embodiment makes it possible to further reduce the pressure film 21 from being damaged by the pressure film supporting member 22, compared to the first embodiment. Therefore, it can further extend the pressure film 21 in service life. By the way, also in the case of this embodiment, it is desired that the above-described ribs 25 are made as narrow as possible to prevent the problem that heat escapes through the ribs 25, and therefore, the portions of the toner image, which correspond in position to the ribs 25, are unsatisfactorily fixed. Further, the number of the ribs 25 is desired to be as large as possible so that the force which the pressure film supporting member 22 receives from the pressure film 21 is evenly distributed across the pressure film supporting member 22 in the lengthwise direction of the pressure film supporting member 22.

[Embodiment 3]

Figure 5:
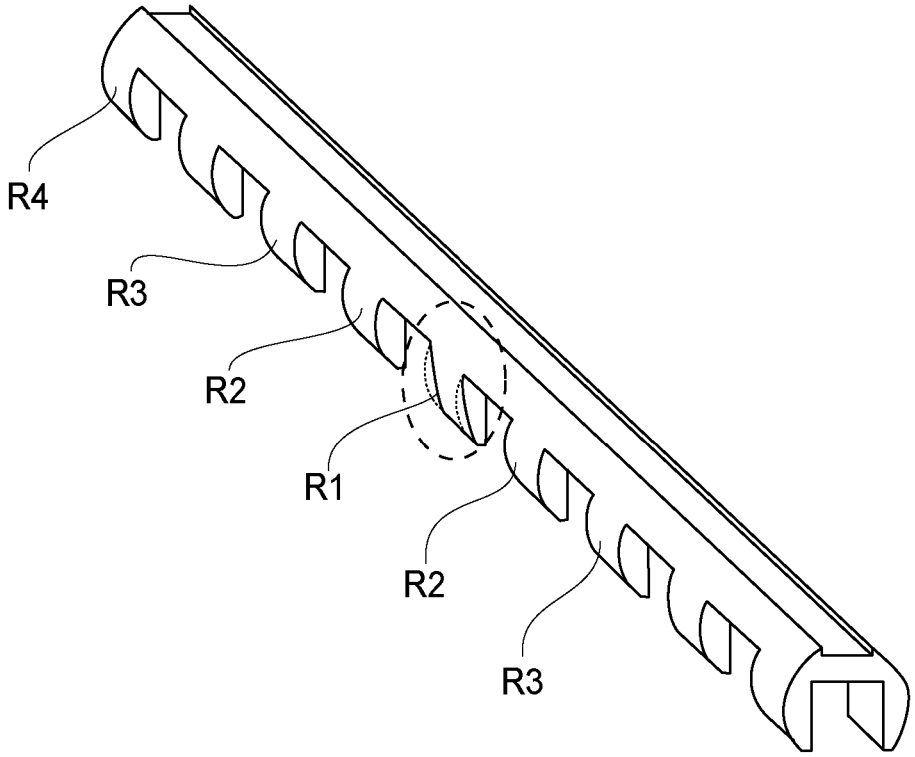
FIG. 5 is a schematic perspective view of the pressure film supporting member having ribs, in the third embodiment of the present invention.

FIG. 5 is a schematic perspective view of the pressure film supporting member 22 in this embodiment. In FIG. 5, referential codes R1, R2 and R3 stand for the radiuses of curvature of the first (central), second, and third ribs 25, respectively, listing from the lengthwise center of the pressure film supporting member 22, and a referential code R4 stands for the radius of curvature of the lengthwise end rib. In this embodiment, the pressure film supporting member 22 is structured so that the outermost ribs 25, second ribs, and third ribs 25 are the same in radius of curvature, and are larger in radius of curvature than the first (central) rib 25: R4=R2=R3>R1. Also in the case of this embodiment, it is desired that the above described ribs 25 are made as narrow as possible to prevent the problem that heat escapes through the ribs 25, and therefore, the portions of the toner image, which correspond in position to the ribs 25, are unsatisfactorily fixed, as in the case of the first and second embodiments. Further, the number of the ribs 25 is desired to be as large as possible so that the force which the pressure film supporting member 22 receives from the pressure film 21 is evenly distributed across the pressure film supporting member 22 in the lengthwise direction of the pressure film supporting member 22.

[Embodiment 4]

Referring to FIGS. 10A, 10B and 100, the fixing device in this embodiment will be described. FIG. 10A is a schematic drawing of the image forming apparatus 100 in this embodiment. FIG. 10B is an enlarged view of the fixing device 5 in this embodiment. FIG. 100 is a perspective view of the entirety of the fixing device 5.

The image forming apparatus 100 which uses an electrophotographic recording method has an image forming section 1 which forms a toner image with the use of four toners which are different in color. The image forming section 1 has four photosensitive members. A referential code 2 stands for a laser scanner which scans the peripheral surface of the peripheral surface of each photosensitive member with a beam of laser light which its outputs while modulating the beam according to the information of the image to be formed. The toner images formed on the photosensitive members, one for one, are transferred in layers onto an intermediary transfer belt 3. Then, they are transferred in a transferring section 4, onto a sheet P of recording medium fed into the main assembly from a sheet feeder cassette 6. After being transferred onto the sheet P, the toner images are fixed to the sheet P by the fixing device 5. The fixing device 5 is disposed in the top portion of the image forming apparatus 100. The direction in which the sheet P is made to enter the fixing device 5 is roughly perpendicular to the bottom surface 100B of the image forming apparatus 100 (it is roughly parallel to direction of gravity g (FIG. 11)).

The fixing device 5 has a heating unit 50, and a pressure roller 40 which forms a fixation nip N3 in cooperation with the heating unit 50. The heating unit 50 has a fixation film 51, a film guiding member 52, a metallic stay 53 which provides the heating unit 50 with rigidity, a ceramic heater 54, and a pair of flanges 55, as regulating members, which regulate the fixation film 51 in lateral deviation, that is, the deviation in the direction parallel to the generatrix of the fixation film 51. The fixation film 51 has a substrative layer formed of thermosetting resin (in this embodiment, thermosetting polyimide), and a fluorine resin layer as the surface layer. Designated by referential codes 56*u* are the upstream ribs of the film guiding member 52 in terms of the recording medium conveyance direction. Designated by referential codes 52*d* are the downstream ribs of the film guiding member 52, in terms of the recording medium conveyance direction. Designated by a referential code 57 is a heater holding groove, with which the film guiding member 52 is provided. The film guiding member 52 is formed of heat resistant resin (in this embodiment, LCP: Liquid crystal polymer). Designated by a referential code 41 is the elastic layer (rubber layer) of the pressure roller 40. The fixation film 51 is circularly moved in the direction (indicated by arrow mark D2) by the rotation of the pressure roller 40 (indicated by arrow mark D1).

The pair of flanges 55 are disposed at the lengthwise ends of the film guiding member 52, one for one. Each flange 55 has a guiding section 55*a* which guides the fixation film 51 by the inward surface of the corresponding lengthwise end of the fixation film 51 (FIG. 12).

(Film Shape when Film is Stationary and in Motion)

FIG. 11 is a schematic sectional view of roughly the center portion of the fixation film 51, at a plane which is perpendicular to the lengthwise direction of the film guiding member 52. It shows the shape of the center portion of the fixation film 51, in which the center portion of the fixation film 51 is when the fixation film 51 is stationary and being rotationally moved. When the fixation film 51 is stationary, it remains slightly separated from the ribs 56*u* because of its own resiliency, whereas when it is being rotationally moved, it is deformed as if it is pushed toward the exit side of the fixation nip N3. On the entrance side of the fixation nip N3, the fixation film 51 comes into contact with the ribs 56*u*.

FIG. 12 is a perspective view of a combination of the film guiding member 52 and flange 55. The film guiding member 52 is structured so that the central rib 56*u* is the smallest in radius of circumference, and the closer a given rib 56*u* is to the central rib 56*u*, the smaller it is in radius of circumference. Further, each of the outermost ribs 56*u* of the film guiding member 52 is structured so that its sections which oppose the fixation film 51 are smaller in contour than the contour of the guiding surface 55*a* of the flange 55. In FIG. 12, referential codes R1-R5 stand for the radiuses of circumference of the second to fifth ribs 56*u*, respectively, counting from the central rib 56*u*. A referential code R6 stands for the radius of circumference of the guiding section 55*a*. In this embodiment, the film guiding member 52 is structured so that there is the following relationship among these radiuses of circumference: R6>R5=R4>R1=R2=R3. That is, the film guiding member 52 is structured so that its virtual film guiding surface on the upstream side of the fixation nip N3 in terms of the film rotation direction, is recessed in slight curvature inward of the film guiding member 52. Thus, this embodiment can reduce the damage which the film guiding member 52 will possibly cause to the fixation film 51 as the film 22 is rotationally moved.

Next, an embodiment of the present invention, which can minimize the excessive amount of temperature increase which occurs to the out-of-sheet-path portions of the fixation nip N3 when a substantial number of small sheets P of recording medium are continuously processed by a fixing device, is described.

[Embodiment 5]

The fixing device in this embodiment is made up of a heating unit 101, a fixing roller 102, and a pressure unit 103. The heating unit 101 and fixing roller 102 are pressed against each other by an unshown pressure applying means, forming thereby a heating nip Nh, in which heat is transferred from the heating unit 101 to the fixing roller 102. The amount of force (pressure) applied by the unshown pressure applying means to the fixing roller 102 is 160 N. In terms of the rotational direction of the fixing roller 102, the width of the heating nip Nh is 8 mm. Similarly, the fixing roller 102 and pressure unit 103 are pressed against each other by an unshown pressure applying means, forming thereby a fixation nip Np. The amount of the force applied to the fixing roller 102 by the pressure applying means is 160 N. In terms of the rotational direction of the fixing roller 102, the width of the fixation nip Np is 8 mm. As the fixing roller 102 is rotated, a sheet P of recording paper on which a toner image T is borne, is conveyed through the fixation nip Np, in which the toner image T on the sheet P is thermally fixed to the sheet P. The recording medium conveyance speed was set to 200 mm/sec.

(Heating Unit)

The heating unit 101 is made up of a heating film 104, a heater supporting member 105, a stay 106, a heater 107, and a temperature detection element 108. The heating film 104 is 233 mm in length in terms of the direction parallel to the generatrix of the fixation film 104, and 18 mm in external diameter. The substrative layer of the heating film 104 is formed of thermosetting polyimide which contains carbon filler, and is 50 μm in thickness. The surface layer of the heating film 104 is formed of PFA, and is 30 μm in thickness.

The heater supporting member 105 is formed of heat resistant resin such as liquid polymer, PPS, PEEK, or the like. It is reinforced by the stay 106 held by the frame of the heating unit 101 in such a manner that it extends in the lengthwise direction of the heater supporting member 105. The stay 106 bears the pressure applied by the unshown pressure applying means, making it possible for the pressure to be evenly distributed across the fixing roller 102 in terms of the lengthwise direction of the fixing roller 102. As the material for the stay 106, such a substance as iron, stainless steel, steel plate coated with zinc chromate, or the like, that is highly rigid is used. Moreover, the stay 106 is shaped so that it becomes U-shaped in cross section, being thereby further increased in rigidity. Thus, the heater supporting member 105 is enabled to form the heating nip Nh, without being warped. The heater 107 is disposed so that it corresponds in position to the heating nip Nh. This heater 107 is made up of a piece of alumina plate which is 1.0 mm in thickness, and a heat generating member formed of silver-palladium alloy, has a length of 222 mm, on the aluminum plate. The heat generating member is coated with a glassy substance.

The temperature of the heater 107 is monitored by the temperature detection element 108. To the heater 107, AC electric power is supplied in accordance with the temperature of the heater 107 detected by the element 108. While the fixing device 5 is used for image fixation, the electric power is controlled so that the detected temperature of the heater 107 remains at a preset level (target temperature). The target temperature in this embodiment is set to a value in a range of 180° C.-220° C.

(Fixing Roller)

The fixing roller 102 is made up of a metallic core formed of iron, aluminum, or the like, an elastic layer formed of highly heat resistant foamed rubber, a thermally highly conductive elastic layer which is formed of silicone rubber, or the like, and which is 2.0 W/(m·K) in thermal conductivity, and a release layer formed of PFA or the like. More specifically, the fixing roller 102 in this embodiment is made up of a metallic core which is 11 mm in external diameter and is formed of iron, an elastic layer which is formed around the metallic core, of a foamed substance, and is 3.5 mm in thickness, a thermally highly conductive rubber layer which is formed around the foamed elastic layer and is 200 μm in thickness, and a piece of electrically insulative PFA tube which is 40 μm in thickness and covers the thermally highly conductive layer. The fixing roller 102 is 56 degrees in hardness, and roughly 18 mm in external diameter. The elastic layer, thermally highly conductive layer, and release layer are 229 mm in length. In order for the fixing roller 102 to be satisfactory in terms of its performance and durability, the hardness of the fixing roller 102 is desired to be in a range of 40 degrees to 70 degrees (measured by hardness gauge of Asker C type, under load of 1 kgf).

(Backup Unit)

The backup unit 108 (pressure application unit) is made up of a fixation film 109, a soaking plate supporting member 110, a stay 111, and a soaking plate 112. The pressure film 109 is a cylindrical member. It is 233 mm in length in terms of the direction parallel to its generatrix, and 18 mm in external diameter. Its innermost layer, which is the substrative layer, is formed of PEEK, and its outermost layer is formed of PFA which is excellent in terms of releasing properties. More specifically, the PEEK layer is 100 μm in thickness, and the PA layer is 30 μm in thickness. The PEEK used as the material for the pressure film 109 in this embodiment is pure PEEK, that is, such PEEK that contains no filler or the like. It is 143° C. in glass transfer point, and 240° C. in melting point Tm.

The soaking plate supporting member 110 is formed of heat resistant resin such as liquid polymer, PPS, PEEK, etc., and is reinforced by the stay 111 which extends in the lengthwise direction of the soaking plate supporting member 110. The stay 111 bears the pressure applied by an unshown pressure applying means, making it possible for the pressure from the pressure applying means to be evenly distributed across the fixing roller 102 in terms of the lengthwise direction of the fixing roller 102. The material for the stay 111 is iron, stainless steel, steel plated coated with zinc chromate, or the like substance, which is excellent in terms of rigidity. The stay 111 is structured so that it becomes U-shaped in cross section, being thereby increased in rigidity. Thus, it can prevent the soaking plate supporting member from being warped, making it possible for the fixation nip Np having a preset width to be formed.

The soaking plate 112 is disposed on the inward side of the pressure film 109. The soaking plate 112 is a piece of aluminum nitride plate, and is 1.0 mm in thickness, 230 mm in length, and 7 mm in width. The PEEK layer of the pressure film 109 contacts this soaking plate 112. When a substantial number of small sheets of recording medium, which are narrower than the heater 107 in terms of the lengthwise direction of the heater 107, and on which a toner image has been formed, are processed by the fixing device, the portions of the fixation nip Np of the fixing device, which are outside the path of the small sheets, tend to excessively increase in temperature. However, the presence of the soaking plate 112 makes it possible to keep the fixation nip Np uniform in temperature; it can prevent the out-of-sheet-path portions of the fixation nip Np from excessively increase in temperature.

(Soaking Plate)

The heater 107 which is the heat source of the heating unit does not directly contact the soaking plate 112. Further, the pressure film 109, which functions as a thermally highly insulative member, is between the heater 107 and soaking plate 112, slowing the speed with which heat is transferred to the soaking plate 112 from the heater 107 while the fixing device 5 is started up. Thus, even through the fixing device is provided with the soaking plate 112, it does not occur that the length of time it takes for the fixing device to start up significantly increases.

(Elasticity of Pressure Film)

FIG. 14 shows the relationship between the temperature of PEEK which is thermoplastic resin, and the elasticity of PEEK, and the relationship between the temperature of PI which is thermosetting resin, and the elasticity of PI. PEEK is 143° C. in glass transition point Tg. Thus, as the temperature of PEEK exceeds its glass transition point Tg, PEEK substantially reduces in elasticity. Thus, the pressure film 109 substantially reduces in rigidity, making it possible that it will become difficult for the pressure film 109 to remain cylindrical. In comparison, the glass transition point Tg of the thermosetting PI is 300° C. Thus, the amount by which the thermosetting PI changes in elasticity within the temperature range in which the fixing device is operated, is very small. Thus, the pressure film 109 hardly changes in rigidity in the temperature range in which the fixing device is operated. It is expected that the temperature of the fixing device in this embodiment exceeds 143° C., or the glass transition point of PEEK, while the fixing device is in use. Thus, it is unavoidable that the pressure film 109 reduces in elasticity while the fixing device is in use. In order to prevent the pressure film 109 from reducing in rigidity while the fixing device is in use, by increasing the pressure film 109 in thickness, the PEEK layer of the pressure film 109 is desired to be no less than 80 μm in thickness. Further, from the standpoint of retarding the heat transfer to the soaking plate 112 from the heater 107 by increasing the pressure film 109 in thermal resistance, the PEEK layer is desired to be no less than 100 μm in thickness. On the other hand, if the PEEK layer is excessively thick, it becomes excessive in rigidity, making it likely for the pressure film 109 to crack. Thus, the thickness of the PEEK layer is desired to be in a range of 80-200 μm.

(Area of Contact Between Pressure Film and Soaking Plate)

FIG. 15 is an enlarged view of the fixation nip formed by the fixing roller 102 and pressure unit 103. The area of contact between the inward surface of the pressure film 109 and the soaking plate 112 is defined as an inward nip Npin.

While the fixing device is started up, the temperature of the pressure film 109 remains below the glass transition point Tg of PEEK, and therefore, the pressure film 109 remains highly rigid. Thus, it is unlikely for the pressure film 109 to conform to the soaking plate 112. Therefore, the inward nip Npin remains small as shown in part (a) of FIG. 15. Thus, the heat transfer from the heater 107 to the film guiding member 52 is likely to remain retarded. Therefore, it is possible to minimize the amount by which the length of time it takes to start up the fixing device is prolonged.

Next, FIG. 16 is a schematic drawing of the fixing device when a small sheet of recording medium is conveyed through the inward nip Npin, in such an attitude that its path becomes narrower than the dimension of the nip Npin in terms of its lengthwise direction. The sheet path portion of the nip Npin is robbed of heat by the sheet of recording medium. Therefore, it is unlikely to excessively increase in temperature. In comparison, the out-of-sheet-path portions of the inward nip Npin are supplied with an unnecessary amount of heat. That is, they are oversupplied with heat. Therefore, they excessively increase in temperature. FIG. 17 shows the changes which occurred to the temperature of the pressure film 109 when a substantial number of postcards (100 mm in width, 148 mm in length, and 209.5 g/m$^2$) were continuously conveyed through the fixing device. The portion of the pressure film 109, which corresponds in position to the sheet path portion of the inward nip Nnip remained to be roughly 100° C., which is lower than the glass transition point Tg of PEEK, whereas the temperature of the portion of the pressure film 109, which corresponds in position to the out-of-sheet-path portion of the inward nip Nnip remained to be roughly 220° C., which was higher than the glass transition point Tg of PEEK. Thus, only the portions of the pressure film 109, which correspond in position to the out-of-sheet-path portion of the inward nip Nnip substantially reduced in rigidity. Thus, it became more likely for the pressure film 109 to conform to the soaking plate 112. Thus, the out-of-sheet-path portions of the inward nip Nnip substantially expanded as shown in part (b) of FIG. 15. Consequently, the out-of-sheet-path portions of the inward nip Npin were increased in the amount by which heat is transferred from the heater 107 to the soaking plate 112. Thus, they were prevented from excessively increasing in temperature.

FIG. 18 shows the relationship between the temperature of the pressure film 109 and the width of inward nip Npin. It is possible to confirm that as the temperature of the pressure film 109 becomes higher than the glass transition point Tg of PEEK, the inward nip Npin substantially increases in size. That is, in an operation in which a substantial number of small sheets of recording medium are continuously process for fixation, the out-of-sheet-path portions of the inward nip Npin enlarge.

In order to verify the above described effect, the fixing device in this embodiment and a comparative fixing device were prepared, and were comparatively evaluated in terms of the productivity in an operation in which small sheets of recording paper were re used as recording medium, and also, in terms of the length of time it took for them to start up.

Both the fixing device in this embodiment and comparative fixing device were of the external heating type shown in FIG. 13, although they were different in the material for the pressure film 109 and the thickness of the pressure film 109. The substrative layer of the pressure film 109 in this embodiment was formed of PEEK and was 100 μm in thickness as described above. The pressure film 109 of the comparative fixing device was a cylindrical member, and was 233 mm in length and 18 mm in external diameter. Its substrative layer was formed of thermosetting PI, and its outermost layer, or the release layer, was form of PFA which is excellent in releasing properties. The thickness of PI layer was 50 μm, and the thickness of the PFA layer was 30 μm. The glass transition point Tg of PI is 300° C. The PI used as the material for the substrative layer of the pressure film 109 was pure; it contained no filler, or the like. Film, the substrative layer of which is PI, is extremely high in glass transition point, and therefore, the subsrative layer is unlikely to reduce in rigidity. However, if the PI layer is excessively increased in thickness, it becomes excessively high in rigidity, becoming likely to crack. Thus, in order to provide the PI layer with a proper amount of rigidity, the thickness of the PI layer was set to 50 μm.

(Productivity of Fixing Device when Small Sheet of Recording Paper is Used as Recording Medium)

The rotational speed of the fixing roller 102 shown in FIG. 13 was set to 150 rpm, and a substantial number of postcards (100 mm in width, 148 mm in length, and 209.5 g/m$^2$ in basis weight) were continuously conveyed through the fixing device for fixation. The fixing device was adjusted in postcard interval (in time) to prevent the surface temperature of the pressure film 109 and that of the fixing roller 102 from exceeding 230° C. The fixing device in this embodiment and the comparative fixing device were compared in productivity under the above described condition. Here, "productivity" means the number of sheets of recording paper which can be processed by the fixing device per minute. Thus, the productivity is expressed in ppm (pages per minute).

(Length of Time it Takes for Fixing Device to be Started Up)

While the rotational speed of the fixing roller 102 was kept at 150 rpm, a substantial number of sheet of paper (Xerox 4203: 215.9 mm in width, 279.4 mm in length, and 75 g/m$^2$ in basis weight) were continuously conveyed through the fixing device. The amount of electric power to be supplied to the heater 107 was set to 1,000 W. The fixing device was started up when its temperature was in the normal range. Under the above described condition, the length of time it took for the temperature of the fixing device to reach the level at which the fixing device becomes satisfactory in fixation performance was measured. Here, "fixing device is satisfactory in fixation performance" means that the fixing device can satisfactorily fix (melt and solidify) a blue monochromatic image formed of magenta toner and cyan toner on a sheet of recording paper, to the sheet.

(Results of Comparative Evaluation)

Table 1 shows the results of the comparative evaluation of the comparative fixing device and the fixing device in this embodiment, in terms of their productivity and length of startup time when they were used to process small sheets of recording paper.

TABLE 1

| | Material of pressing film | Startup time | Productivity for small size sheets |
|---|---|---|---|
| Comp. Ex. | PI | 10.5 sec | 10 ppm |
| Embodiment | PEEK | 10.0 sec | 15 ppm |

In the case of the comparative fixing device, the pressure film 109 functioned as a thermal resistor (barrier). Therefore, the heat transfer from the heat source to the soaking plate was retarded. Thus, the fixing device did not increase in the length of startup time.

However, the substrative layer of the pressure film of the comparative fixing device was PI. Therefore, even though the out-of-sheet-path portions of the inward nip Npin were excessively increased by the continuous conveyance of small sheets of recording paper, the inward nip Npin showed virtually no change in width. Therefore, it did not occur that the heat transfer from the heat source to the soaking plate increases in the out-of-sheet-path portions. Therefore, the comparative fixing device was not satisfactory in terms of its productivity when it was used to process small sheets of recording paper.

In comparison, in the case of the fixing device in this embodiment, the temperature of the pressure film 109 remained below the glass transition point Tg of PEEK. Therefore, the pressure film 109 remained highly rigid. Thus, the pressure film 109 did not conform to the soaking plate 112, and therefore, the inward nip Npin did not expand. Further, the pressure film 109 functioned as a thermal barrier of a large capacity, minimizing thereby the heat transfer from the heat source to the soaking plate 112. Therefore, the heat transfer from the heat source to the soaking plate 112 was retarded. Thus, the fixing device was prevented from increasing in the length of startup time.

On the other hand, as the out-of-sheet-path portions were excessively increased in temperature by the continuous conveyance of small sheets of recording paper, the temperature of the out-of-sheet-path portions of the pressure film 109 sometimes became higher than the glass transfer point Tg, although the sheet-path portion of the pressure film 109 remained below the glass transition point Tg. Thus, the out-of-sheet-path portions of the pressure film 109 substantially reduced in rigidity. Therefore, the pressure film 109 conformed to the soaking plate 112. Thus, the inward nip Npin substantially expanded. Consequently, the fixing device was increased in the heat transfer to the out-of-sheet-path portions of the soaking plate 112, being therefore increased in the efficiency with which the out-of-sheet-path portions of the inward nip Npin is prevented from excessively increasing in temperature; the inward nip Np was prevented from becoming excessively nonuniform in temperature. Therefore, the fixing device in this embodiment was greater than the comparative fixing device, in the number of sheets of recording paper they could convey through their inward nip Npin.

By the way, in this embodiment, PEEK was selected as the material for the pressure film. However, a substance other than PEEK may be selected as the material for the pressure film 109, as long as its melting point is higher than the temperature level which the pressure film reaches during fixation, and its glass transition point is lower than the temperature level which the pressure film reaches during fixation. For example, the material for the pressure film may be PEK (polyetherketone), PEKEKK (polyetherketone-ether-ketone-ketone), or the like. They can provide the same effects as those described above.

FIG. 19 is an example of the modification of the fixing device 5 in the fifth embodiment. This fixing device forms a fixation by causing its heating unit 301 and pressure unit to contact with each other. The pressure unit is the same in structure as the one in the fifth embodiment, and therefore, is not described. The heating unit 301 is made up of a heat roller 304 and a heat generation source 308. The heat roller 304 has a substrative layer formed of aluminum, and a release layer formed of PFA. The heat roller 304 is rotated by the rotational force transmitted to the heat roller 304 from a driving force source, and the pressure film 109 is rotated by the rotation of the heat roller 304.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2014-158590 filed on Aug. 4, 2014 and 2015-106244 filed on May 26, 2015, which are hereby incorporated by reference herein in their entirety.

What is claimed is:

1. A fixing device comprising:

an elastic roller; and a back-up unit cooperative with said elastic roller to form a fixing nip therebetween, said back-up unit including a cylindrical film contacting said elastic roller, a film guide, extending inside said film in a generatrix direction of said film, configured to guide said film, and an end portion guiding member provided at an end portion of said film guiding member, said end portion guiding member including a guiding portion configured to guide an inner surface of an end portion of said film with respect to the generatrix direction, wherein a toner image is heat-fixed on a recording material while feeding a recording material carrying a toner image through said nip, wherein said film guide has a channel-like cross-section extending longitudinally along an inner periphery of said cylindrical film and includes a plurality of ribs extending circumferentially along the inner periphery of said cylindrical film, said ribs each including a curved surface convex toward an upstream side with respect to the feeding direction of the recording material, wherein upstream most portions of the convex surfaces of longitudinally middle ribs between longitudinally opposite end ribs are retracted more toward a downstream side with respect to the feeding direction of the recording material than those of the longitudinally opposite end ribs, and, wherein the convex surfaces of the longitudinally middle ribs are less strongly curved than those of the longitudinally opposite end ribs.

2. A device according to claim 1, wherein said film is made of thermoplastic resin material.

3. A device according to claim 1, further comprising a heating unit contacting a surface of said elastic roller to apply the heat to said elastic roller.

4. A device according to claim 1, further comprising a heater contacting the inner surface of said film.

* * * * *